United States Patent [19]

Franklin

[11] Patent Number: 4,689,611

[45] Date of Patent: Aug. 25, 1987

[54] ALARM AND COMMUNICATION SYSTEM FOR WATER SKIERS

[76] Inventor: Samuel H. Franklin, 4253 E. 72nd St. South, Tulsa, Okla. 74136

[21] Appl. No.: 731,937

[22] Filed: May 8, 1985

[51] Int. Cl.[4] ..... G08B 1/08

[52] U.S. Cl. ..... 340/539; 340/573; 343/718; 441/69; 455/100

[58] Field of Search ..... 340/573, 539, 572, 574; 343/718; 200/DIG. 2; 455/100; 441/69; 128/903

[56] References Cited

U.S. PATENT DOCUMENTS

| | | | |
|---|---|---|---|
| 3,018,474 | 1/1962 | Cluck et al. | 340/573 X |
| 3,798,631 | 3/1974 | Langford | 340/573 X |
| 3,902,118 | 8/1975 | Ikrath et al. | 343/718 X |
| 4,483,683 | 11/1984 | Alley, Sr. | 455/100 X |
| 4,549,169 | 10/1985 | Moura et al. | 340/573 X |

*Primary Examiner*—Glen R. Swann, III
*Assistant Examiner*—Thomas J. Mullen, Jr.
*Attorney, Agent, or Firm*—Head Johnson Stevenson

[57] ABSTRACT

An alarm and communication system for water skiers as provided for use with a boat having a driver and a ski rope secured at one end to the back of the boat and a handle at the other end of the rope to which the skier holds, the system including a battery powered radio receiver positioned on the boat, the receiver having an antenna and being arranged to receive a pre-selected radio signal frequency, an alarm switch connected to the radio receiver to provide a closed contact in the absence of the reception by the receiver of a signal of pre-selected frequency and wattage, an alarm connected to the switch, and a radio transmitter, antenna and power source of a size to be supported above the water as a skier holds to a ski rope handle and is supported on the water surface when pulled by the boat, the transmitter antenna being arranged to transmit at the pre-selected frequency of the receiver and of selected wattage sufficient that when the skier is ahold of the ski rope handle and supported above the water surface the alarm switch is kept in the open position but which transmitter and antenna transmit insufficient wattage to keep the alarm switch open when the skier does not have hold of the ski rope handle and is not being supported above the surface of the water whereby the driver of the boat is provided a signal when the skier releases hold on the ski rope handle.

3 Claims, 8 Drawing Figures

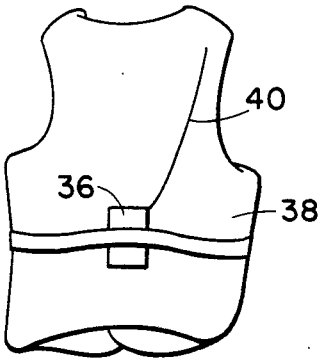
Fig. 3
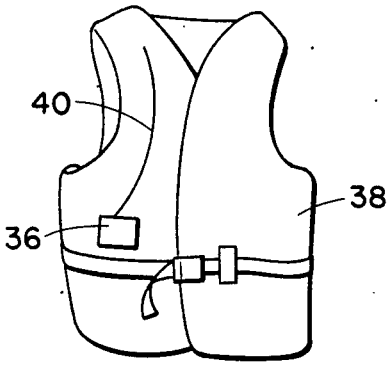
Fig. 4
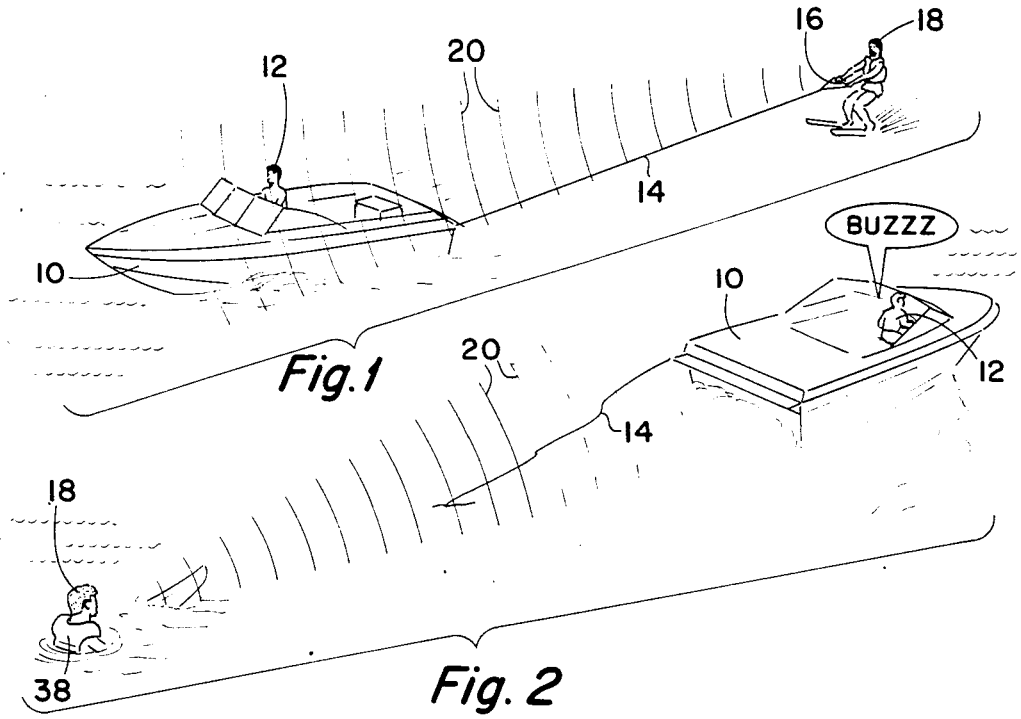
Fig. 1
Fig. 2
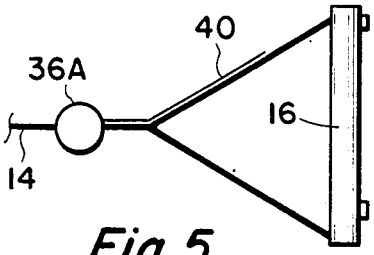
Fig. 5

ALARM AND COMMUNICATION SYSTEM FOR WATER SKIERS

SUMMARY OF THE INVENTION

Water skiing is an important and enjoyable recreational activity. It is important that the driver of a boat pulling a water skier know immediately if the water skier falls or releases hold of the ski rope by which he is pulled. Since the driver of a boat must be constantly alert to conditions forwardly of the boat as he pilots it over the water surface, the boat driver is prevented from constantly turning to observe the condition of the skier. For this reason, it is customary, when possible, to have a second person in the boat to apprise the driver when the skier has fallen off; otherwise, the driver can drive the boat a long distance from the location of the skier, leaving him in a perilous condition in the water and subject to being hit by other ski boat operators or even subjecting the fallen skier to being hit by his own driver, if the driver is in the process of turning the boat at the time the skier falls.

The present invention is directed towards a device to immediately apprise a boat operator if the skier he is pulling falls or voluntarily releases hold on the ski rope handle.

Others have provided systems for giving alarms when the skier releases hold on a ski rope handle such as U.S. Pat. No. 3,109,075 which employs a switch responsive to the pull of the skier. This type of system functions to a degree, however, it is time consuming to hook up and unhook from the boat. In addition, in many skiing activities the skier's actions cause slack to occur in the rope which thereby gives false signals. Another patent relating to a device for providing a signal when pressure is released from a ski rope handle is U.S. Pat. No. 3,018,474. An additional example of a ski rope signal system is U.S. Pat. No. 3,798,631 which also responds to pull on the rope. These prior issued patents illustrate the importance of providing a signal when a skier falls or voluntarily releases hold from the handle as he is being pulled by a ski boat but have certain limitations which have not made them commonly employed.

The present invention provides a system in which it is not necessary to utilize a signal wire in conjunction with the ski rope nor a switch which is actuated by pull on the ski rope. Instead, the present invention employs the use of a radio transmitter and receiver. In one embodiment the transmitter is carried on the person of the skier, such as by attachment to his life vest. Affixed to and as a part of the receiver which is carried on the boat, is an alarm switch which is closed when the receiver receives the transmission of the signal above the preselected wattage level. When the signal is not received above the preselected wattage level the switch closes. An alarm is actuated by the switch to provide a signal to the boat operator.

A small transmitter carried by or in conjunction with the skier may be in the form of a small device affixed to the body of the skier, such as by attachment to the skier's life jacket with a short antenna extending therefrom also affixed to the life jacket. As long as the skier is above the water and being pulled by the ski boat the strength (wattage) of the signal transmitted is sufficient to keep the alarm on the boat turned off. If the skier turns lose of the rope and settles into the water, or falls while skiing and therefore is forced to release hold of the rope, the transmission wattage is immediately reduced. In addition the rapid increase in distance between the skier and the boat will further reduce the wattage of the signal received at the receiver.

In a preferred embodiment the transmitter is contained within the ski rope handle and includes an antenna which is wrapped on the surface of the handle. The antenna may be covered by a insulating film. With the transmitter transmitting and the skier having hold of the handle, the transmitted frequency is imparted to the skier, either by direct electrical contact of the skier with the antenna or more preferably, by capacity and inductive coupling of the antenna to the body of the skier as a consequence of the close engagement of the hand of the skier about the coiled antenna. In this preferred embodiment the transmitter, power source which may be in the form of a small dry cell battery, and other circuitry is integrally contained within the ski rope handle. The system does not require any conductor extending from the ski rope handle to the boat. The receiver and alarm may be integrally contained with power supplied by small dry cell battery.

The invention will be better understood with reference to the following description and claims taken in conjunction with the attached drawing.

DESCRIPTION OF VIEWS

FIG. 1 illustrates a boat being driven, pulling a skier, the skier having a radio transmitting system associated with him and the boat having a radio receiver and showing the radio signal being transmitted and received at the boat.

FIG. 2 shows a skier having released hold of the ski rope handle or having fallen from his skis. As the skier and/or the ski rope handle fall into the water the wattage of the radio signal received at the boat quickly diminishes, causing an alarm to be given to the boat driver.

FIG. 3 shows one arrangement wherein a small portable transmitter with a self-contained battery and antenna are affixed to the rearward portion of a ski vest.

FIG. 4 shows the same system supported on the front of a ski vest.

FIG. 5 shows a portion of a ski rope attached to a ski rope handle and showing the arrangement wherein the transmitter is supported in a water-proof housing attached to the ski rope immediately in front of the handle.

DETAILED DESCRIPTION

Figure 6:
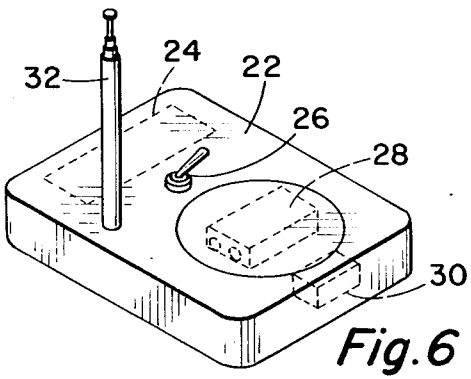
FIG. 6 shows an embodiment of a receiver, antenna and battery in a self-contained arrangement which may be positioned on the ski boat.

Referring to the drawings and first to FIG. 1, a ski boat is indicated by numeral 10, with a driver 12, and including a ski rope 14 attached at one end thereof to the back of the boat. At the other end of the ski rope 14 is a handle 16 having a skier 18 ahold of it. With the boat moving over the water the skier is supported on skis and is supported on the water surface so that the skier and the ski rope handle 16 are both supported above the water surface.

FIG. 2 shows the situation in which the skier 18 has voluntarily released hold of the ski rope handle or has fallen. The ski rope handle is not seen in FIG. 2 since it is below the water surface or, it may be on the water surface, but is not supported above the water surface nor is the skier 18 supported above the water surface.

The present invention serves to provide an alarm in the circumstances of FIG. 2. For this purpose a radio signal 20 is transmitted when the skier 18 has hold of the ski rope handle 16 and is above the water surface. When the skier releases hold of the ski rope handle, as in FIG. 2, and is, therefore, no longer supported above the water surface, the transmitted radio signal 20 greatly decreases in amplitude so that the wattage of the signal received at the ski boat 10 substantially reduces and this reduced signal reception functions to sound an alarm.

Figure 7:
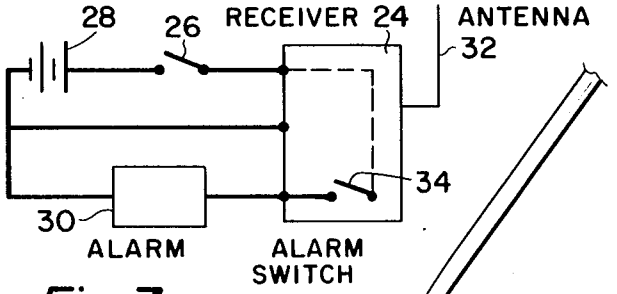
FIG. 7 is a block diagram of the receiver, alarm switch, alarm, power source and antenna as employed in the receiver such as illustrated in FIG. 6.

FIGS. 6 and 7 show the typical arrangement of the receiver. A base 22, in FIG. 6, houses a receiver circuit 24, an ON-OFF switch 26, a self-contained energy source such as a small dry cell battery 28, an alarm, such as a buzzer 30, and an antenna 32. The device of FIG. 6, being small and self-containing, may be readily positioned on and removed from the ski boat 10 of FIGS. 1 and 2 as needed. The arrangement of FIG. 6 is merely exemplary and it can be seen that the receiver may be of a multitude of different physical arrangements.

FIG. 7 is a block rudimentary wiring diagram of the receiver of FIG. 6. The receiver includes an alarm switch 34 which is normally open when the radio frequency signal received is of a preselected minimum wattage but is closed when the signal received is below such minimum preselected power level.

Referring to FIGS. 3 and 4, a transmitter 36, which is preferably a small solid state, waterproof housed device is be attached directly to the rear of a life vest 38. The transmitter has an antenna 40 extending from it which may in like manner be secured to the vest 38. In FIG. 4 the transmitter 36 and antenna 40 are shown affixed to the front of the life vest 38.

With the arrangement of FIGS. 3 and 4, when the skier falls in the water as illustrated in FIG. 2, the transmitter and, more importantly, the antenna 40 are substantially submerged in the water so that the effective energy of the signal being transmitted is substantially reduced. This, coupled with the rapid increase in distance between the skier 18 and ski boat 10 results in the transmitted signal 20 received at the boat being rapidly diminished, that is, the transmitted energy received by the receiver antenna 32 is quickly decreased. This causes the alarm switch 34 to close, actuating alarm 30.

FIG. 5 shows an alternate arrangement in which the transmitter 36A is housed in a small body attached to the ski rope 14 immediately adjacent to the handle 16. The transmitting antenna 40 may be secured to a portion of the ski rope adjacent to the handle 16. In the embodiment of FIG. 5, when the skier falls from or voluntarily releases hold on the handle 16 the transmitter 36A and antenna 40 immediately fall on or below the surface of the water so that the effective signal transmitted is substantially reduced, thereby sounding an alarm 30 on the ski boat 10.

Figure 8:
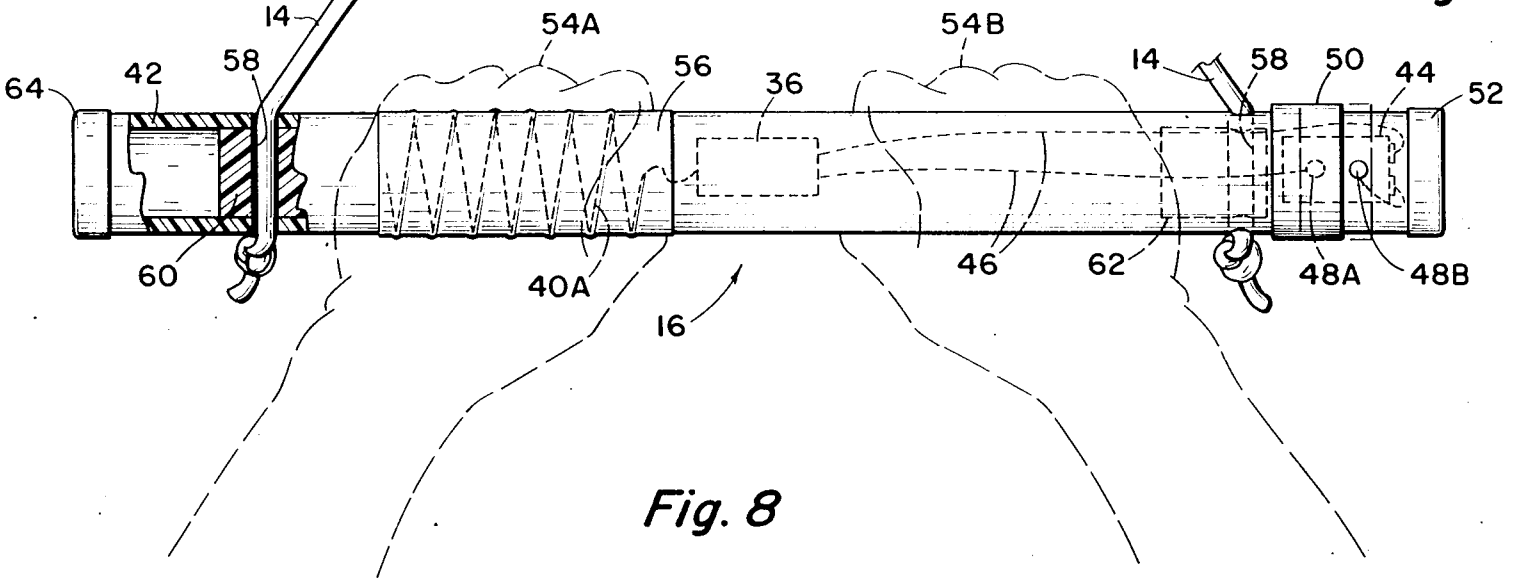
FIG. 8 is an illustration of a preferred method of practicing the invention in which the transmitter, power source and antenna are contained in and on a ski rope handle and wherein the antenna is arranged such that the body of the skier, as he holds on to the ski rope handle, becomes a portion of the transmitting antenna.

Referring to FIG. 8, a preferred embodiment of the invention is illustrated. In this embodiment a ski rope handle, indicated by the numeral 16, is formed of a generally tubular body 42 which may be of plastic. Within the interior or the tubular body 42 is positioned the transmitter 36. A power source for the transmitter, in the form of a small dry cell battery 44, is also contained within the tubular body 42. By means of conductors 46 voltage from the battery is supplied to the transmitter. In order to activate and deactivate the transmitter, contactors 48A and 48B extend through the tubular body 42 and are engaged by conductors 46. A conductive ring 50 on the exterior of the tubular body 42 functions as a switch. In FIG. 8 the switch is shown in the OFF position but when the ring 50 is slid to the right it engages both the contactors 48A and 48B to close the circuit and, by means of conductors 46, supplies electrical energy to the transmitter 36. The battery 44 is contained within a compartment adjacent one end of the tubular handle 42 and is replaceable by means of removing a waterproof end cap 52.

An important aspect of the embodiment of FIG. 8 is the arrangement of the transmitter antenna. In this embodiment the antenna 40A extends from the transmitter 36 and is wound or coiled about the exterior surface of the tubular housing 42 in a position on the handle 16 wherein it will normally be covered by one hand 54A of the skier. The antenna 40A may be exposed on the exterior surface of the tubular housing 42 of the handle for direct electrical contact with the hand 54A of the skier or, more preferably, is covered by a thin insulative plastic covering 56. The arrangement of FIG. 8 causes the signal generated by transmitter 36 and fed to antenna 40A to be coupled to the hand 54A of the skier. Thus, the skier's body becomes a part of the transmitting antenna. When the skier releases hold on handle 16, voluntarily or involuntarily, the power transmitted by transmitter 36 available to be received by the receiving antenna 32 on the ski boat 10 is immediately and substantially reduced.

The tubular body 42 has openings 58 to receive portions of the ski rope 14. Seal plugs 60 and 62 are positioned within the interior of the ski rope handle tubular body 42 to make the interior which contains transmitter 36, waterproof. In addition, the interior is, except for the transmitter 36 and conductors 46, substantially hollow so that the ski rope handle will float. Battery 44 is contained within the end compartment formed between float 62 and end cap 52. The opposite end cap 64 also serves to provide a void space within the interior of the tubular body 42 to add to the buoyancy of the ski rope handle.

The skier can communicate with the driver by grasping and releasing the ON-OFF ring 50 located on the end of the ski handle. While he is in contact with the ring the transmitted signal is interrupted and the buzzer 30 sounds. Repeated grasping and releasing causes repeated buzzing. Owner devised codes can be used to convey the skier's message. For example, one buzz-go faster; two buzzes-slow down. This happens because a portion of the radiated signal comes through the battery itself. By means of contacting the antenna with one hand 54A and grasping and releasing the ON/OFF ring 50 with other hand 54B the radiated power is substantially reduced.

Communication can also be achieved by interrupting power to transmitter 36 by use of the ON and OFF switch ring 50. If the transmitter and antenna system are calibrated in such a way that sufficient transmitted power to keep switch 34 in the OFF position depends upon the skier's hand 54A being in close proximity to antenna 40A, he can signal by releasing grasp on the handle 16 with hand 54A while still holding with hand 54B. These are merely examples of the way the invention can be used to permit communication between the skier and the boat driver.

The embodiments illustrated in FIGS. 6 and 8 show how the invention may be practiced utilizing two separate self-contained integral components which can be immediately and quickly adapted to any ski boat system. No wiring needs to take place in the boat itself. The operator only replaces existing ski rope handles by the handle illustrated in FIG. 8 and positions the receiver of FIG. 6 on his boat and is then immediately equipped to provide an alarm when the skier he is pulling falls or releases hold of the ski rope handle.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An alarm system for a water skier for use with a boat having a driver and a ski rope secured at one end to the back of the boat comprising:

a handle at the other end of the ski rope to which the skier holds;

a radio receiver connected to a power source and positionable on a boat, the receiver having an antenna and being arranged to receive a preselected radio signal frequency;

an alarm switch connected to said receiver and arranged to provide a closed contact in the absence of the reception by said receiver of a radio signal of preselected frequency and wattage;

an alarm connected to said switch, the alarm being activated by the closure of said switch to apprise a drive of a boat of the absence of a detected radio frequency of preselected frequency and wattage; and a radio transmitter and power source contained within said ski rope handle, including an antenna in the form of a conductor coiled on the external surface of said handle for coupling transmitter signals to the hand of a skier when the skier is ahold of the handle, the transmitter being arranged to transmit at a preselected frequency and with selected wattage sufficient when a skier is ahold of said ski rope handle so as to keep said alarm switch in the opened position, but which transmitter transmits insufficient wattage to keep said alarm switch open when the skier does not have hold of said ski rope handle.

2. An alarm system according to claim 1 including an insulative cover over said conductor coiled on the exterior surface of said handle wherein coupling of the transmitter antenna to the body of a skier is by capacitance and/or inductance means.

3. An alarm system according to claim 1 including switch means actuatable on the exterior of said handle for actuating and deactuating said transmitter whereby a skier ahold of said handle may signal the driver of a boat having said radio receiver therein.

* * * * *